US009932794B2

(12) United States Patent
Keese

(10) Patent No.: US 9,932,794 B2
(45) Date of Patent: Apr. 3, 2018

(54) ROTATING LOCKING DEVICE WITH SECONDARY RELEASE MECHANISM

(75) Inventor: Joachim Keese, Hannover (DE)

(73) Assignee: Cameron International Corporation, Houston, TX (US)

( * ) Notice: Subject to any disclaimer, the term of this patent is extended or adjusted under 35 U.S.C. 154(b) by 51 days.

(21) Appl. No.: 14/415,895

(22) PCT Filed: Jul. 20, 2012

(86) PCT No.: PCT/EP2012/003104

§ 371 (c)(1),
(2), (4) Date: Jan. 20, 2015

(87) PCT Pub. No.: WO2014/012566

PCT Pub. Date: Jan. 23, 2014

(65) Prior Publication Data

US 2015/0184479 A1 Jul. 2, 2015

(51) Int. Cl.

| | |
|---|---|
| ***E21B 33/038*** | (2006.01) |
| *E21B 23/00* | (2006.01) |
| *E21B 7/12* | (2006.01) |
| *E21B 19/00* | (2006.01) |
| *E21B 34/04* | (2006.01) |
| *E21B 33/035* | (2006.01) |

(Continued)

(52) U.S. Cl.
CPC ..... *E21B 33/038* (2013.01)

(58) Field of Classification Search
None
See application file for complete search history.

(56) References Cited

U.S. PATENT DOCUMENTS 3,820,600 A * 6/1974 Baugh ..... E21B 33/038 166/338
3,960,456 A * 6/1976 Norris ..... F16B 19/02 116/208

(Continued)

FOREIGN PATENT DOCUMENTS

| | | |
|---|---|---|
| EP | 2299051 A2 | 3/2011 |
| GB | 2408299 A | 5/2005 |

OTHER PUBLICATIONS

PCT International Search Report and Written Opinion dated Apr. 24, 2013, for International Application No. PCT/EP2012/003104, International filing date Jul. 20, 2012 (11 p.)

*Primary Examiner* — Matthew R Buck
*Assistant Examiner* — Douglas S Wood
(74) *Attorney, Agent, or Firm* — Conley Rose, P.C.

(57) ABSTRACT

A rotating locking device includes a locking arm, including a throughbore, coupled to a housing and axially rotatable relative to the housing. The rotating locking device also includes a plunger including a biasing profile disposed within the throughbore and a locking head coupled to a distal end of the locking arm, the locking head including a recess to at least partially receive the distal end of the locking arm. The rotating locking device further comprises a load pin that couples the locking head to the distal end of the locking arm and is configured to resist separation of the locking head and the locking arm when in a securing position. Axial translation of the plunger causes the biasing profile to engage the load pin and cause the load pin to transition to a breakaway position.

19 Claims, 11 Drawing Sheets

(51) Int. Cl.
*E21B 41/04* (2006.01)
*B25G 3/18* (2006.01)

(56) References Cited

U.S. PATENT DOCUMENTS

| | | | | |
|---|---|---|---|---|
| 5,795,093 | A * | 8/1998 | Seaton | F16B 21/065 166/338 |
| 7,243,729 | B2 * | 7/2007 | Tyrrell | E21B 33/0355 166/338 |
| 8,020,623 | B2 * | 9/2011 | Parks | E21B 33/0355 166/339 |
| 2008/0202760 | A1 | 8/2008 | Cosgrove et al. | |

* cited by examiner

ROTATING LOCKING DEVICE WITH SECONDARY RELEASE MECHANISM

CROSS-REFERENCE TO RELATED APPLICATIONS

This application is a 35 U.S.C. § 371 national stage application of PCT/EP2012/003104 filed Jul. 20, 2012 and entitled "Rotating Locking Device with Secondary Release Mechanism," which is hereby incorporated herein by reference in its entirety for all purposes.

STATEMENT REGARDING FEDERALLY SPONSORED RESEARCH OR DEVELOPMENT

Not applicable.

BACKGROUND

In subsea hydrocarbon drilling operations, a Christmas tree may be installed on a wellhead to control the flow of fluids to and from the well. The Christmas tree contains various actuators, control valves, chokes and the like that are controlled by a subsea control module (SCM). The SCM is an electro-hydraulic unit that is coupled to the Christmas tree and may provide hydraulic or electronic control to the Christmas tree, as well as enable communications with a surface vessel. The SCM and Christmas tree are often coupled to one other via hydraulic couplers, which may be subject to separation forces. To reduce the likelihood of unwanted separation, many hydraulic couplers employ a locking mechanism. For example, traditional locking mechanisms often employ a nut-and-screw arrangement to oppose separation forces acting on the SCM and the Christmas tree.

In some cases, it is beneficial to retrieve the SCM to repair an electronic malfunction of one of the electronic components of the SCM, to repair a hydraulic leak, or to repair or refurbish the SCM due to normal wear and tear caused by subsea environmental conditions, for example. Unfortunately, the locking device may not operate as intended. For example, corrosion, contamination, or other interference may prevent the nut from unthreading from the screw and, as such, may negatively impact the locking mechanism's operation. In such a situation, the SCM's ability to be retrieved is hampered.

SUMMARY OF DISCLOSED EMBODIMENTS

In accordance with various embodiments of the present disclosure, a rotating locking device includes a locking arm, including a throughbore, coupled to a housing and axially rotatable relative to the housing. The rotating locking device also includes a plunger including a biasing profile disposed within the throughbore and a locking head coupled to a distal end of the locking arm, the locking head including a recess to at least partially receive the distal end of the locking arm. The rotating locking device further comprises a load pin that couples the locking head to the distal end of the locking arm and is configured to resist separation of the locking head and the locking arm when in a securing position. Axial translation of the plunger causes the biasing profile to engage the load pin and cause the load pin to transition to a breakaway position.

In accordance with another embodiment of the present disclosure, a subsea control module includes one or more electrical or hydraulic connectors to couple to a subsea device to be controlled by the subsea control module, one or more control submodules configured to operate the electrical or hydraulic connectors, and a rotating locking device configured to couple the subsea control module to the subsea device. The rotating locking device includes a locking arm, including a throughbore, coupled to a housing and axially rotatable relative to the housing, which is fixed relative to the subsea control module. The rotating locking device also includes a plunger including a biasing profile disposed within the throughbore and a locking head coupled to a distal end of the locking arm, the locking head including a recess to at least partially receive the distal end of the locking arm. The rotating locking device further includes a load pin that couples the locking head to the distal end of the locking arm and is configured to resist separation of the locking head and the locking arm when in a securing position. Axial translation of the plunger causes the biasing profile to engage the load pin and cause the load pin to transition to a breakaway position. The subsea control module also includes a lift mandrel coupled to the plunger such that movement of the lift mandrel induces an axial translation of the plunger.

In accordance with yet another embodiment of the present disclosure, a method of unlocking a subsea control module from a subsea device includes inducing axial translation of a plunger disposed within a throughbore of a locking arm coupled to a locking head. The locking head is in a locked position to couple the subsea control module to the subsea device. The method further includes, as a result of inducing axial translation of the plunger, engaging by a biasing profile of the plunger a load pin that couples the locking head to the locking arm, causing the load pin to transition to a breakaway position. Finally, the method includes applying a breakaway force to the locking arm causing the locking arm to decouple from the locking head.

BRIEF DESCRIPTION OF THE DRAWINGS

For a more detailed description of the embodiments, reference will now be made to the following accompanying drawings.

DETAILED DESCRIPTION OF THE DISCLOSED EMBODIMENTS

Figure 1:
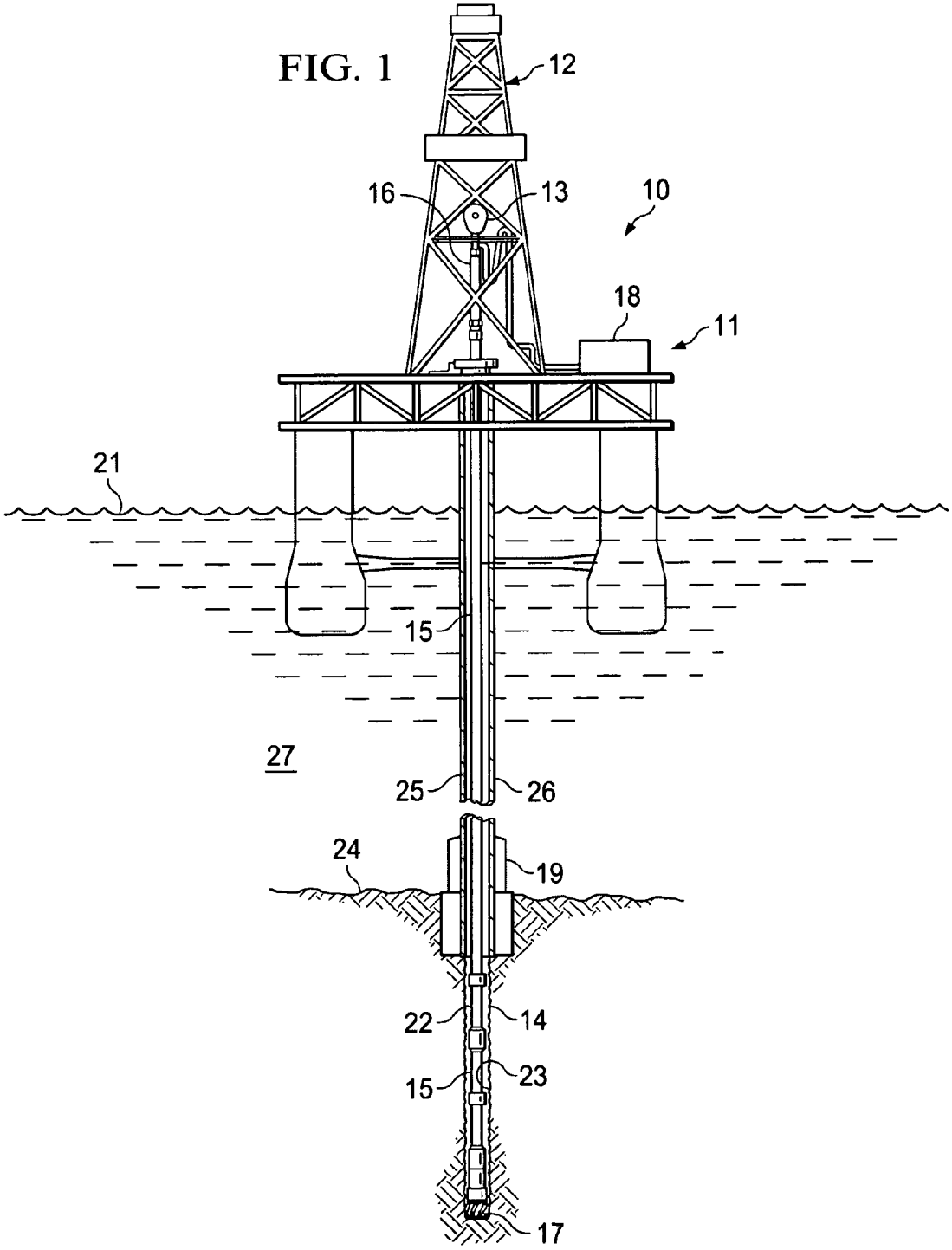
FIG. 1 shows an offshore rig in accordance with various embodiments of the present disclosure.

In the drawings and description that follow, like parts are identified throughout the specification and drawings with the same reference numerals. The drawings are not necessarily to scale. Certain features of the invention may be shown exaggerated in scale or in somewhat schematic form and some details of conventional elements may not be shown in the interest of clarity and conciseness. The invention is subject to embodiments of different forms. Some specific embodiments are described in detail and are shown in the drawings with the understanding that the disclosure is to be considered an exemplification of the principles of the invention and is not intended to limit the invention to the illustrated and described embodiments. The different teachings of the embodiments discussed below may be employed separately or in any suitable combination to produce desired results. The terms "connect," "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring now to FIG. 1, a schematic of an offshore rig 10 is shown. The rig 10 comprises a platform 11 equipped with a derrick 12 that supports a hoist 13. Drilling of oil and gas wells, and maintenance operations on subsea equipment, is often carried out by a string of drill pipes connected together by "tool" joints 14 so as to form a drill string 15 extending subsea from the platform 11. The hoist 13 suspends a kelly 16 used to lower the drill string 15. During drilling operations, the lower end of the drill string 15 is connected to a drill bit 17, which is rotated by rotating the drill string 15 and/or a downhole motor (e.g., downhole mud motor). Drilling fluid, also referred to as drilling "mud," is pumped by mud-recirculation equipment 18 (e.g., mud pumps, shakers, etc.) located on the platform 11. The drilling mud is pumped at a relatively high pressure and volume through the drilling kelly 16 and down the drill string 15 to the drill bit 17. The drilling mud exits the drill bit 17 through nozzles or jets in face of the drill bit 17. The mud then returns to the platform 11 at the sea surface 21 via an annulus 22 between the drill string 15 and the borehole 23, through the subsea wellhead 19 at the sea floor 24, and up an annulus 25 between the drill string 15 and a casing 26 extending through the sea 27 from the subsea wellhead 19 to the platform 11. At the sea surface 21, the drilling mud is cleaned and then recirculated by the recirculation equipment 18. The drilling mud is used to cool the drill bit 17, to carry cuttings from the base of the borehole to the platform 11, and to balance the hydrostatic pressure in the rock formations. After the well has been drilled, a Christmas tree to control the flow of hydrocarbons from the well is placed on the wellhead 19.

Figure 2A:
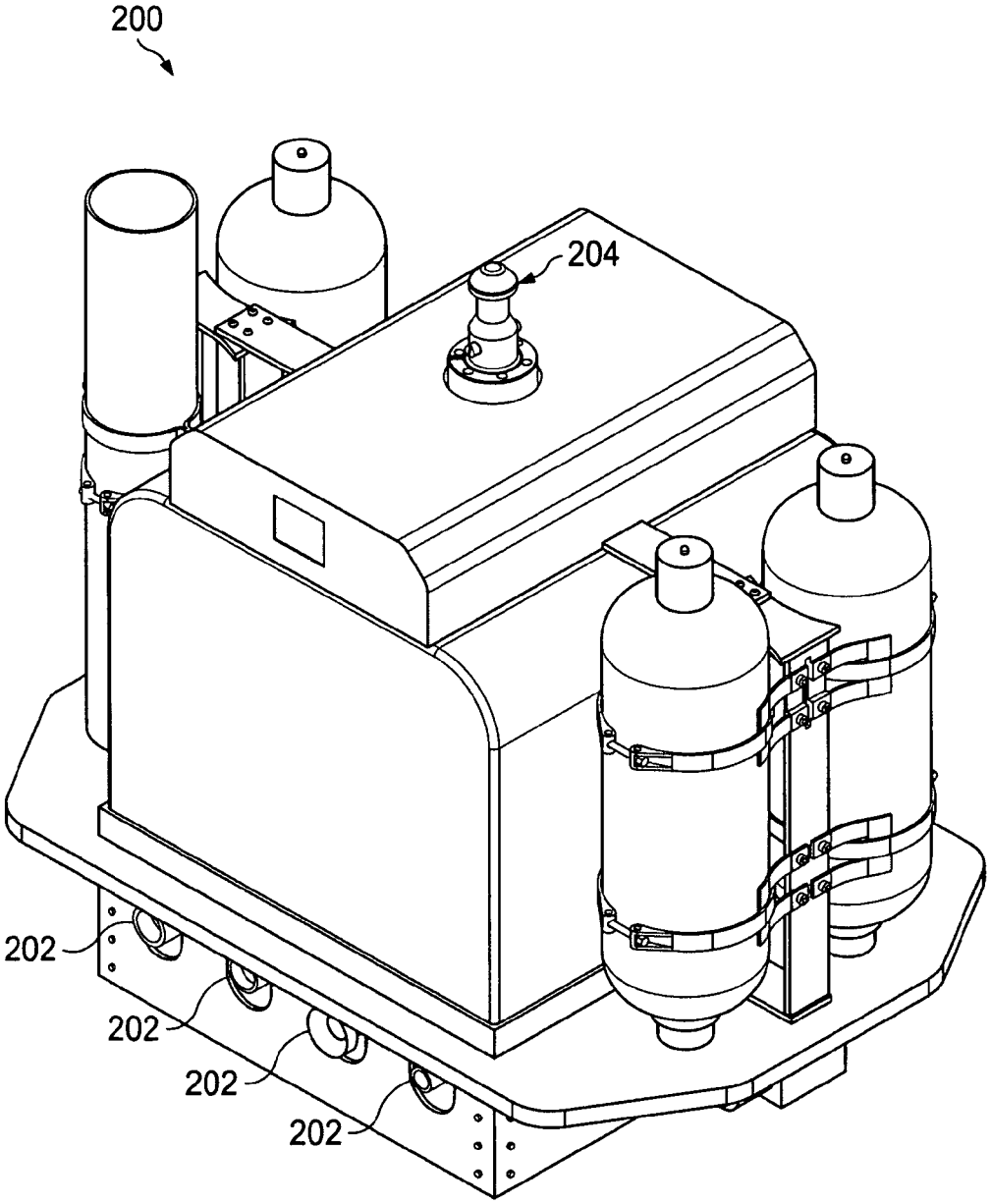
FIGS. 2*a*-2*d* are multiple perspective views of a subsea control module (SCM) including a rotating locking device and FIG. 2*e* is a view of the SCM and rotating locking device coupled to a subsea device in accordance with various embodiments of the present disclosure.

FIG. 2*a* shows a subsea control module (SCM) 200 in accordance with various embodiments of the present disclosure. The SCM 200 comprises various electronic and hydraulic control submodules (not shown) for communicating with corresponding equipment on the surface as well as communicating with and controlling the functions of subsea devices, such as a subsea Christmas tree. The SCM 200 includes electrical connectors 202, which may be operated by the electronic control submodules (e.g., the electronic control submodules may transmit or receive electronic signals via the electrical connectors 202) to communicate with the surface or a subsea device that is controlled by the SCM 200. The SCM 200 also includes a lift mandrel 202, the function of which will be explained in further detail below.

Figure 2B:
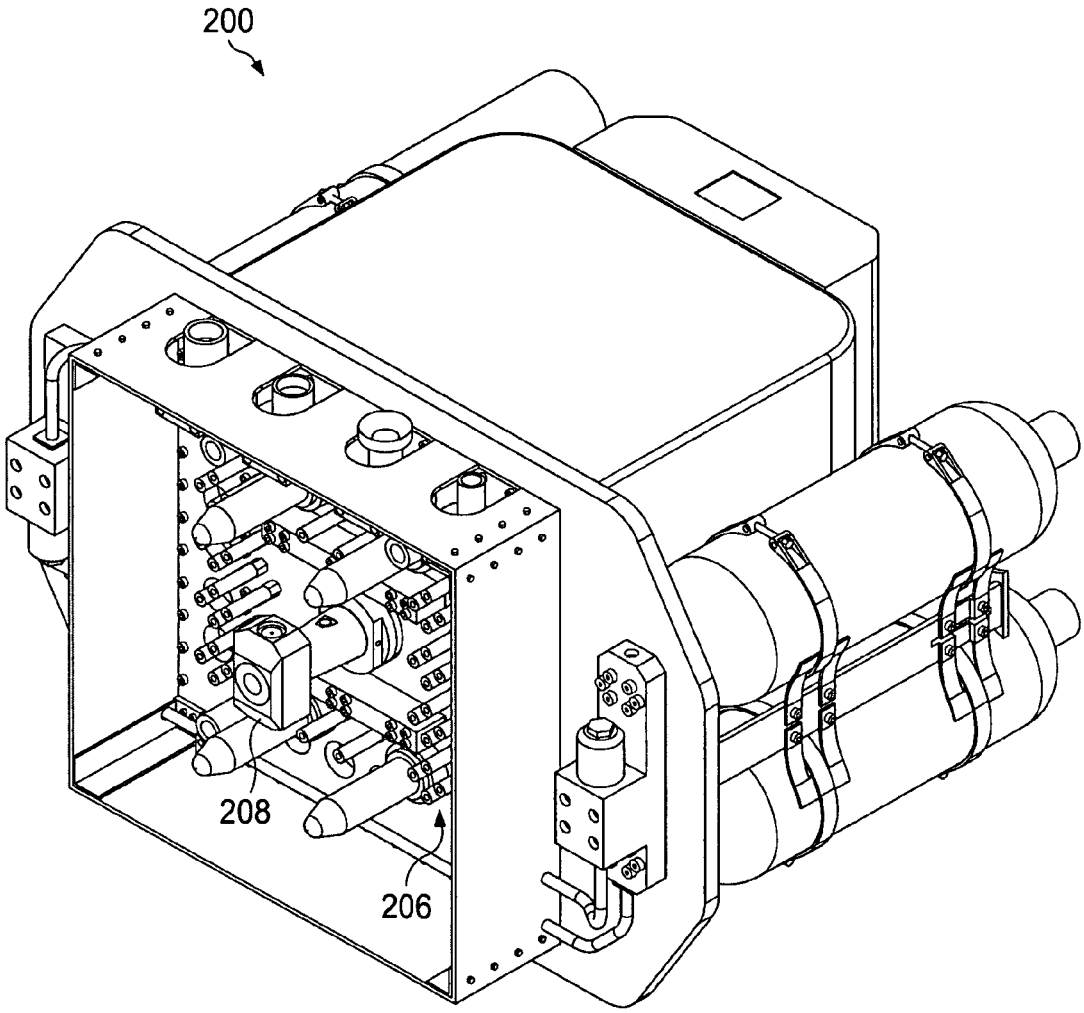

FIG. 2*b* shows a bottom view of the SCM 200. The SCM 200 includes hydraulic connectors 206, which are coupled to a subsea device and may be operated by the hydraulic control submodules to control various valves, actuators and the like of the subsea device. The hydraulic control submodules may also monitor hydraulic sensors of the subsea device through the hydraulic connectors 206. The SCM 200 also includes a rotating locking device 208 in accordance with various embodiments of the present disclosure. In some cases, the hydraulic connectors 206 may experience separation forces (e.g., when hydraulic fluid is pumped from the SCM 200 to a connected subsea device). In the illustrated SCM 200, the rotating locking device 208 engages a corresponding recess of the subsea device, for example, to lock the SCM 200 to the subsea device and oppose any separation forces experienced by the hydraulic connectors 208.

Figure 2C:
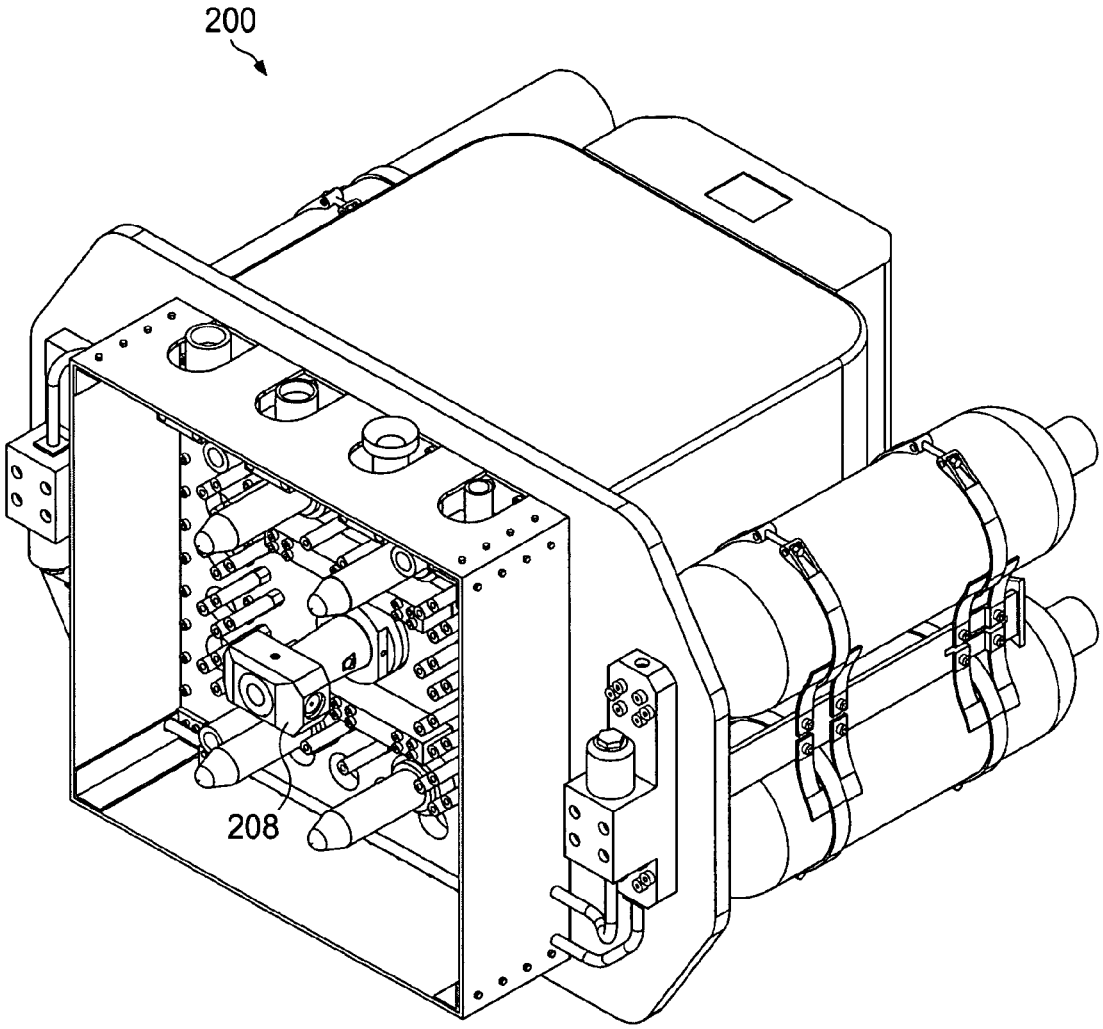
Figure 2D:
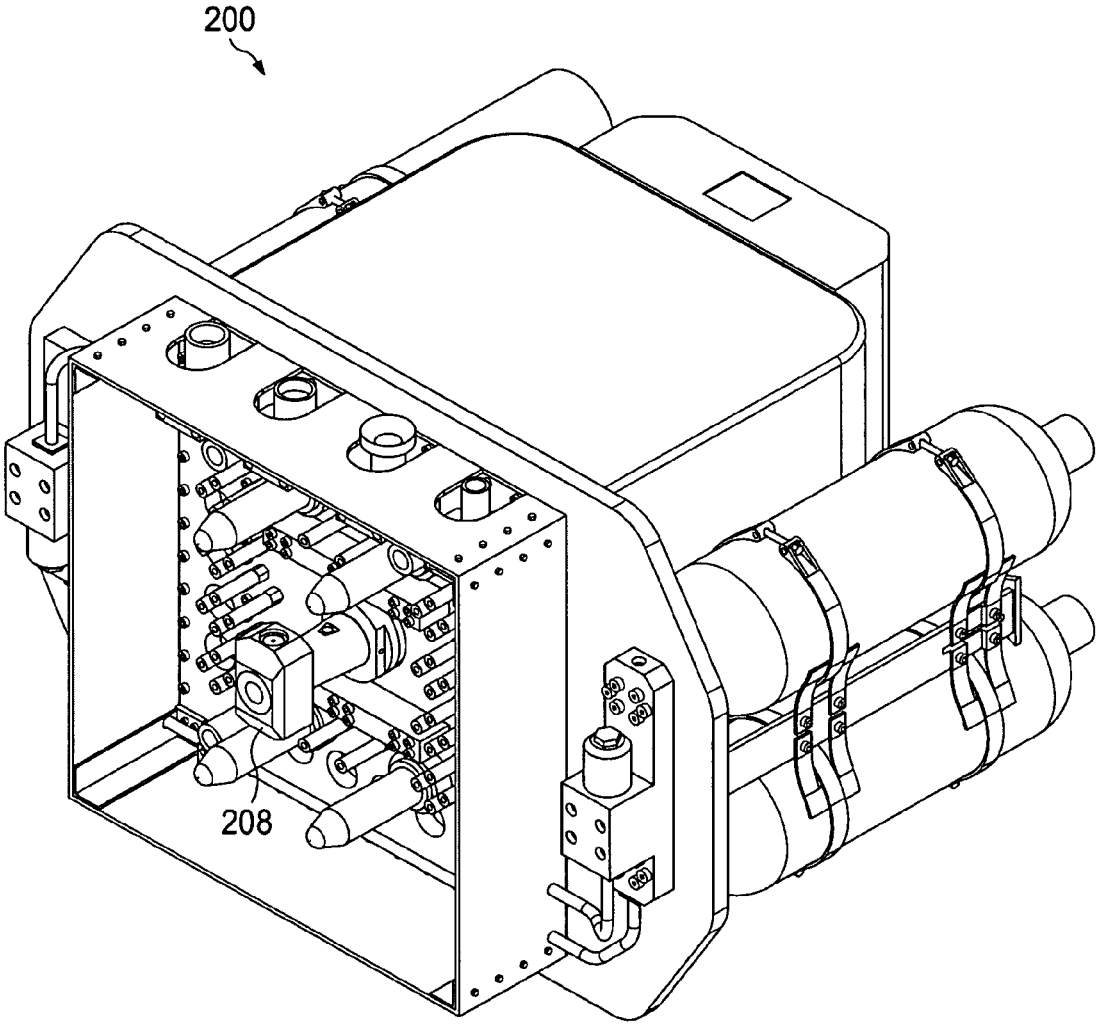

FIGS. 2*c* and 2*d* each show a bottom view of the SCM 200. In FIG. 2*c*, the rotating locking device 208 is in an unlocked position (i.e., a position in which the rotating locking device 208 will pass through a corresponding recess of the subsea device). In FIG. 2*d*, the rotating locking device 208 is in a locked position (i.e., a position in which the rotating locking device 208 will be unable to pass through the corresponding recess of the subsea device). In the locked position, a head of the rotating locking device 208 is rotated approximately 90 degrees relative to the unlocked position.

Figure 2E:
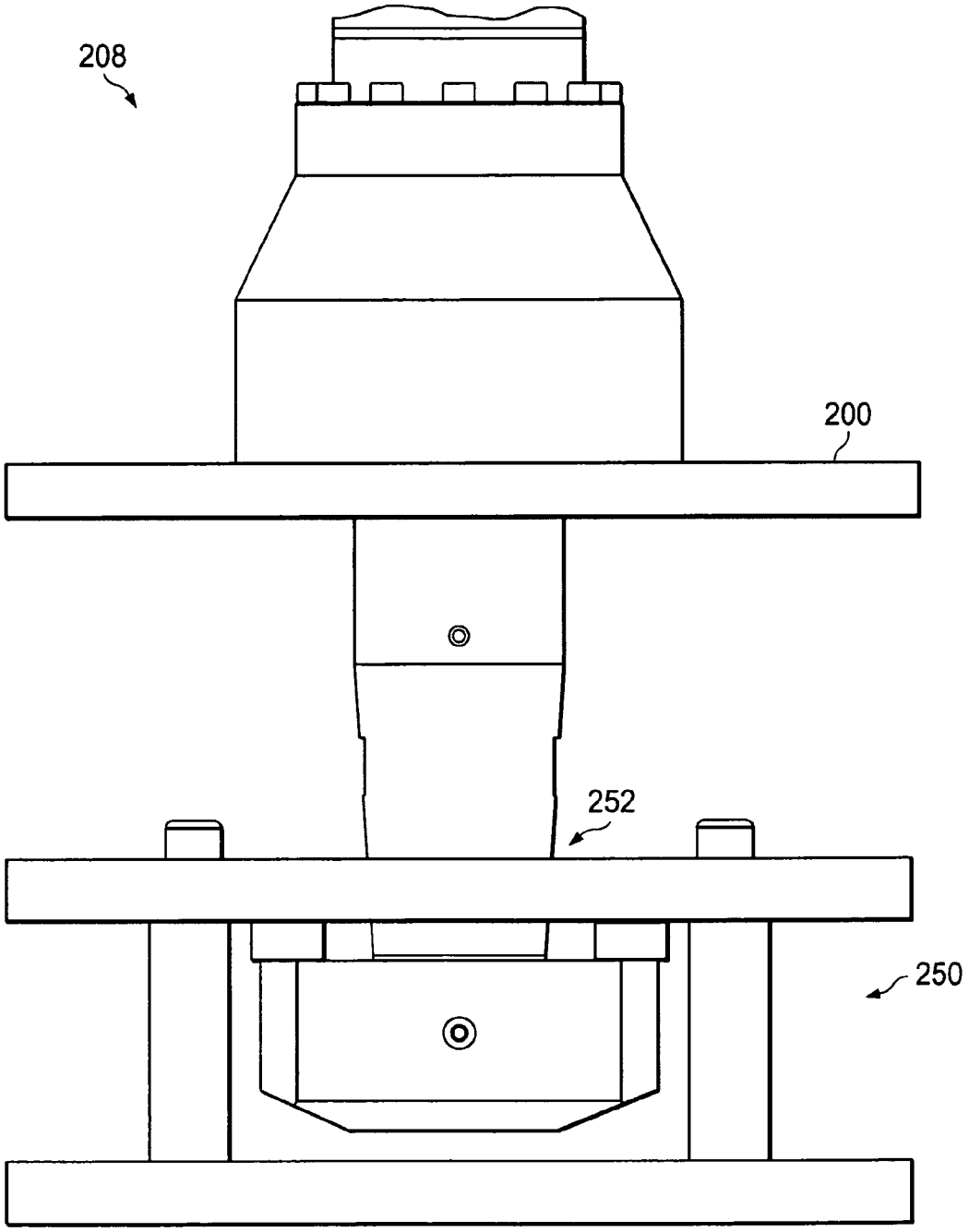

One skilled in the art appreciates that the SCM 200, with the rotating locking device 208 in the unlocked position, may be positioned adjacent to the subsea device by using a remote-operated vehicle (ROV), for example. The ROV may position the SCM 200 such that the rotating locking device 208 engages the corresponding recess of the subsea device. Subsequently, a running tool operated by the ROV causes the rotating locking device 208 to transition to the locked position, locking the SCM 200 to the subsea device and preventing accidental decoupling resulting from, for example, separation forces experienced by the hydraulic connectors 206. In some embodiments, the rotating locking device 208 may include a cam that draws the SCM 200 toward the subsea device as the rotating locking device 208 is transitioned to the locked position. Referring briefly to FIG. 2*e*, an example of the interface between the SCM 200 coupled to a subsea device 250 is shown. The rotating locking device 208, which is coupled to the SCM 200, engages a corresponding recess 252 of the subsea device 250.

Figure 3A:
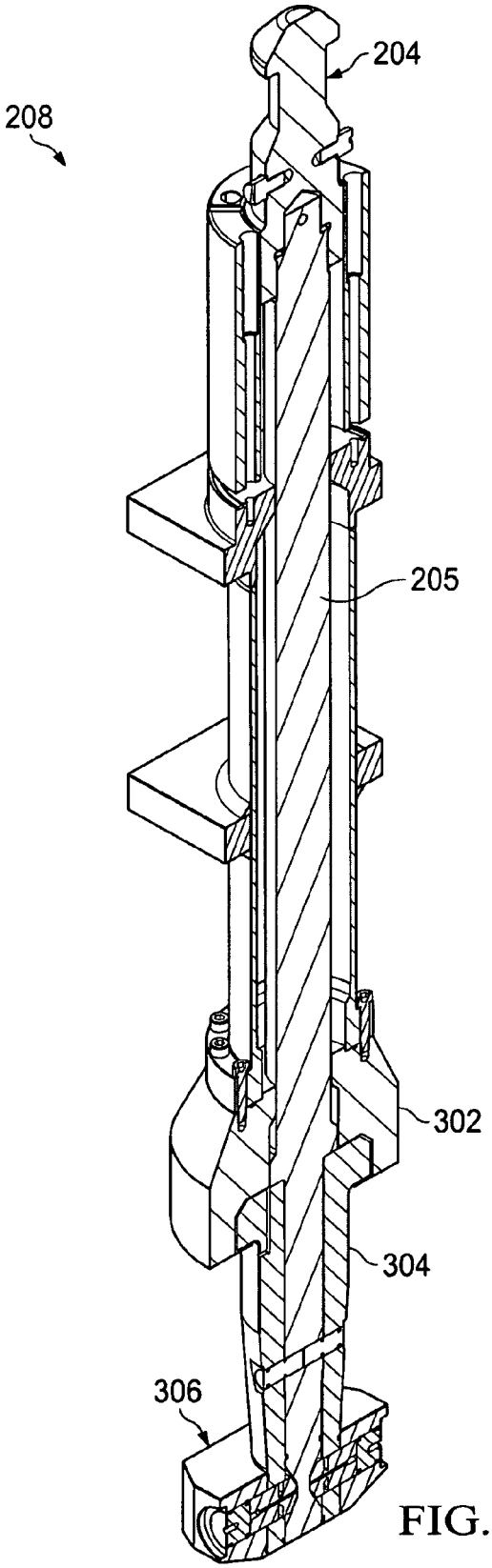
FIGS. 3*a*-3*d* are multiple perspective and cross-sectional views of a rotating locking device in accordance with various embodiments of the present disclosure.

Turning now to FIG. 3*a*, the rotating locking device 208 is shown in further detail. The rotating locking device includes a housing 302, which may be fixed to the chassis of SCM 200. A locking arm 304 extends from the housing 302 and is able to rotate relative to the housing 302. A locking head 306 is coupled to the distal end of the locking arm 304. As shown, the locking arm 304 extends entirely through a cutout in the locking head 306; however, the locking head 306 may alternatively include a recess (not shown) to receive the distal end of the locking arm 304. The lift mandrel 204 shown in FIG. 2*a* is connected to an extension rod 205, which will be explained in further detail below.

Figure 3B:
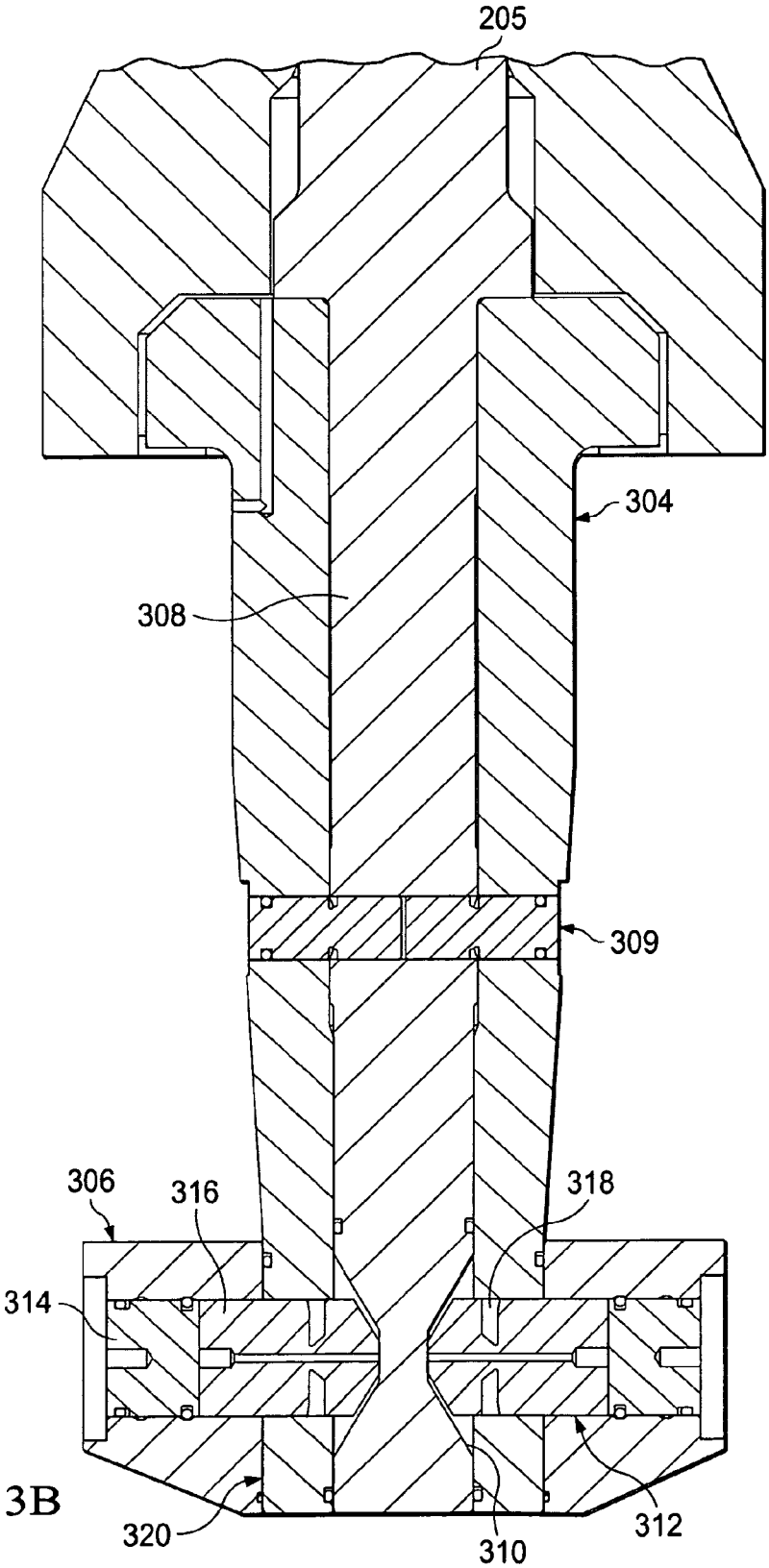

FIG. 3*b* is a cross-sectional view of the locking arm 304 and locking head 306 in accordance with various embodiments of the present disclosure. The locking arm 304 includes a throughbore and a plunger 308 is disposed within the throughbore. The plunger 308 couples to the extension rod 205 that is connected to the lift mandrel 204 as explained above. The plunger 208 and the extension rod 205 may be formed from a single piece of material or may be formed by coupling two distinct portions of material together. A main shear pin 309 couples the plunger to the locking arm 304 and is configured to shear when a predetermined amount of axial force is applied to the plunger 308 (e.g., via the lift mandrel 204 and the extension rod 205). The plunger 308 includes a biasing profile 310 and is able to translate axially through the throughbore after the main shear pin 309 shears. In some embodiments, the main shear pin 309 shears at approximately 80,000N of force. One or more load pins 312 secure the locking head 306 to the locking arm and may be held in place with, for example, an end cap 314. The end cap 314 may comprise one or more seals for protecting the load pins 312 from environmental conditions. Additionally, the space between the plunger 308 and the load pin 312 may be filled with oil or grease to prevent corrosion or contamination of the components. The load pin 312 includes both a section having normal radial thickness 316 and a section having a reduced radial thickness 318. These sections may be described as having an increased shear strength and having a reduced shear strength, respectively.

As shown in FIG. 3*b*, the load pin 312 is in a securing position where the section having an increased shear strength 316 is aligned with an interface 320 between the locking head 306 and the locking arm 304. In the securing position, the load pin 312 resists separation of the locking head 306 from the locking arm 304, and the rotating locking device 208 is able to secure the SCM 200 to another subsea device. As explained above, it may be necessary to retrieve the SCM 200, for example to repair an electronic malfunction of one of the electronic components of the SCM 200, to repair a hydraulic leak, or to repair or refurbish the SCM 200 due to normal wear and tear caused by subsea environmental conditions. However, corrosion, environmental contamination, or other interference may prevent the rotating locking device 208 from being rotated to cause the locking head 306 to be in the unlocked position. Thus, a secondary release mechanism is beneficial.

Figure 3C:
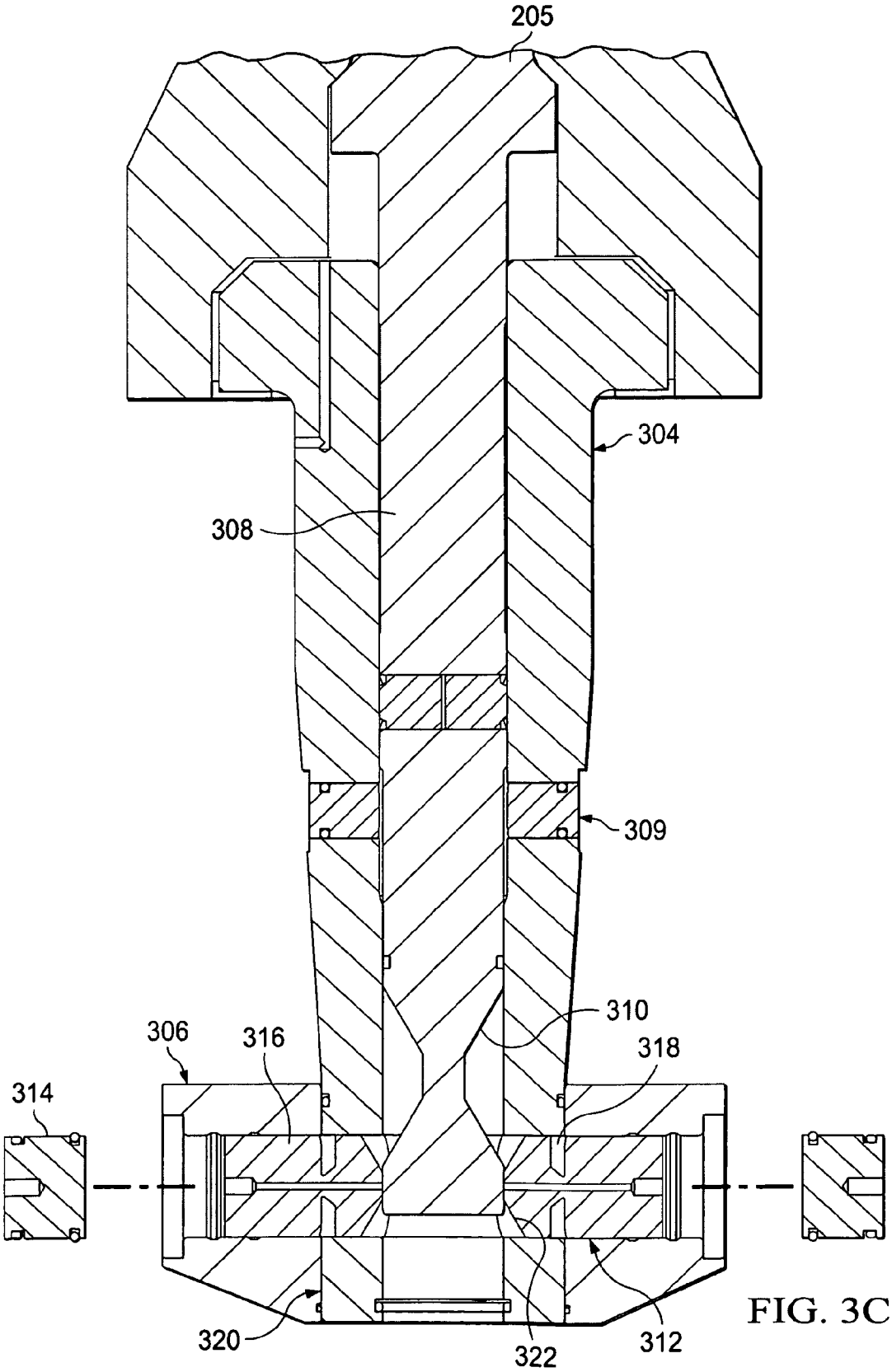

FIG. 3*c* shows the plunger 308 after axial translation through the throughbore, which causes the biasing profile 310 to engage the load pin 312, urging the load pin 312 outward into a breakaway position. As explained above, the plunger 308 is coupled to the lift mandrel 204 via the extension rod 205 such that lifting the lift mandrel 204 induces axial translation of the plunger 308 through the throughbore of the locking arm 304. The lift mandrel 204 may be manipulated by a running tool operated by an ROV, for example. The running tool applies sufficient force to the lift mandrel such that the main shear pin 309 shears, and the plunger 308 is able to axially translate through the throughbore. Alternatively, other types of manipulation (e.g., rotation) of the lift mandrel 204 may similarly induce axial translation of the plunger 308.

In some cases, when the load pin 312 is urged outward, the end cap 314 may separate from the locking head 306 as shown. The biasing profile 310 and the corresponding geometry 322 of the load pin 312 may be designed such that when the load pin 312 is urged outward by the plunger, the section having a reduced shear strength 318 is aligned with the interface 320 between the locking head 306 and the locking arm 304.

Figure 3D:
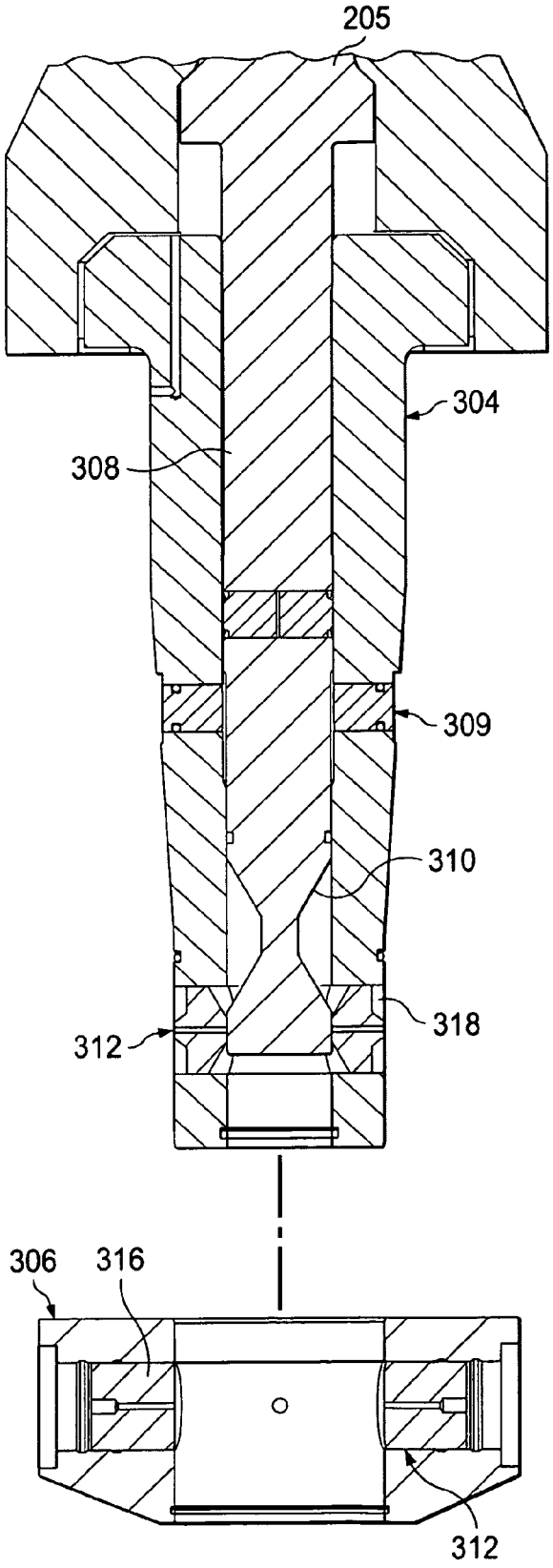

When the load pin 312 is in the breakaway position, the locking arm 304 may be separated from the locking head 306 by applying an axial force to the locking arm 304 sufficient to cause the load pin 312 to shear at the section of reduced shear strength 318, as shown in FIG. 3*d*. This force is referred to as a "breakaway force" and may be approximately equal to 30,000N. The load pin 312 shears as a result of the section 318 being aligned with the interface 320 between the locking head 306 and the locking arm 304. When the load pin 312 is in the securing position, the section having an increased shear strength 316 is aligned with the interface 320 between the locking head 306 and the locking arm 304 and thus the application of a breakaway force to the locking arm 304 does not cause the load pin 312 to shear. In accordance with various embodiments of the present disclosure, once the load pin 312 shears, the locking arm 304 is decoupled from the locking head 306 and the SCM 200 may be retrieved even if the rotating locking device 208 cannot be unlocked in a normal manner.

In some embodiments, axial force may be applied to the locking arm 304 via the lift mandrel 204 and the plunger 308. For example, after axial translation of the plunger 308 causes the load pin 312 to transition to the breakaway position, a portion of the plunger 308 engages a stop, boss, or the like of the locking arm 304, causing additional force applied to the plunger 308 via the lift mandrel 204 to be transferred to the locking arm 304. The breakaway force may be approximately equal to the force required to induce axial translation of the plunger 308.

In other embodiments, force may be applied directly to the locking arm 304 by manipulating a separate mandrel (not shown) that is coupled to the locking arm 304. For example, after axial translation of the plunger 308 causes the load pin 312 to transition to the breakaway position, a breakaway force may be applied to the locking arm 304 by manipulating a mandrel or similar device other than the lift mandrel 204.

Figure 4:
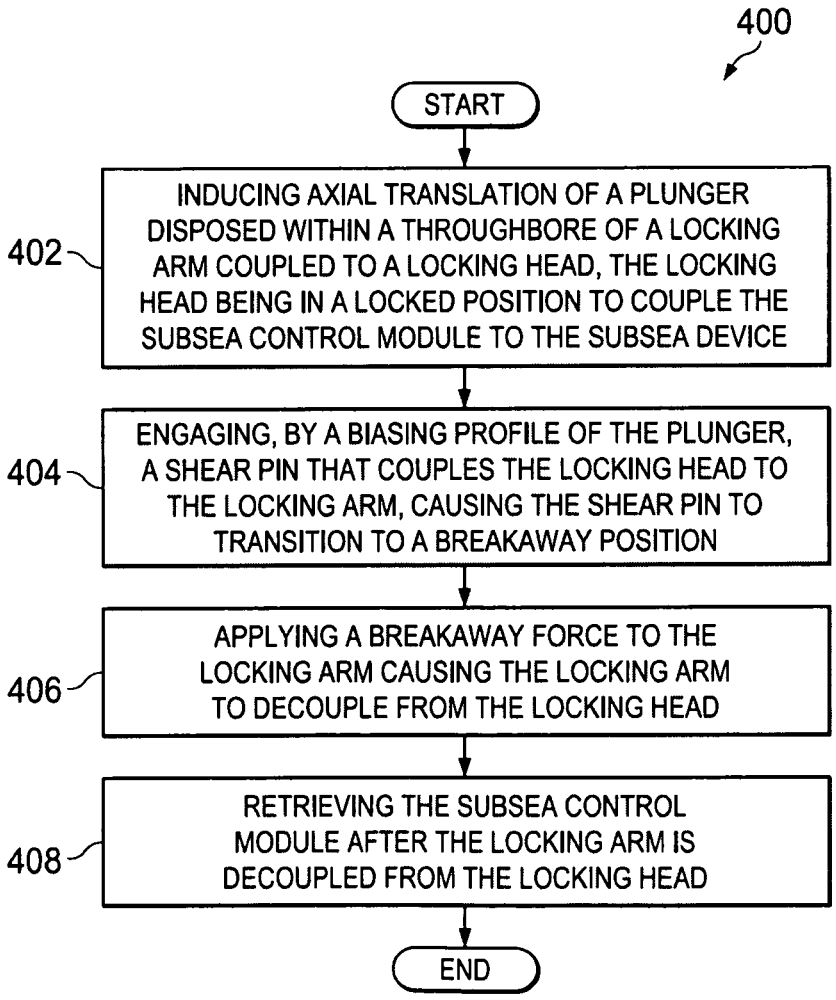
FIG. 4 is a flow chart of a method for unlocking a subsea control module from a subsea device in accordance with various embodiments of the present disclosure.

FIG. 4 shows a method 400 in accordance with various embodiments of the present disclosure. The method 400 begins in block 402 with inducing axial translation of a plunger 308 disposed within a throughbore of a locking arm 304 coupled to a locking head 306. In some embodiments, the locking head 306 is in a locked position, which couples a SCM 200 to the subsea device and opposes separation forces caused by connectors between the SCM 200 and the subsea device. The method 400 continues in block 404 with engaging, by a biasing profile 310 of the plunger 308, a load pin 312 that couples the locking head 306 to the locking arm 304. As explained above, this engagement is a result of inducing axial translation of the plunger 308, for example by manipulating the lift mandrel 204. The load pin 312 transitions to a breakaway position when the load pin 312 is engaged by the biasing profile 310. The method 400 continues in block 406 with applying a breakaway force to the locking arm 304, which causes the locking arm 304 to decouple from the locking head 306, for example as shown in FIG. 3*d*. In some embodiments, the method 400 may further continue in block 408 with retrieving the SCM 200 after the locking arm 304 is decoupled from the locking head 306. For example, a ROV may retrieve the SCM 200.

While specific embodiments have been shown and described, modifications can be made by one skilled in the art without departing from the spirit or teaching of this invention. The embodiments as described are exemplary only and are not limiting. Many variations and modifications are possible and are within the scope of the invention. For example, although described with respect to a subsea control module, the rotating locking device with a secondary release mechanism may be employed on any number of devices, particularly those devices where it is important to have a failover option to release the locking device in the event the locking device cannot be normally unlocked. As another example, although the locking head is shown as having a generally rectangular profile, other shapes may be similarly employed such that rotation of the locking head causes the locking device to lock or unlock from a receptacle or receiving member. Accordingly, the scope of protection is not limited to the embodiments described, but is only limited by the claims that follow, the scope of which shall include all equivalents of the subject matter of the claims.

What is claimed is:

1. A rotating locking device, comprising:

a locking arm coupled to a housing and axially rotatable relative to the housing, the locking arm comprising a throughbore;

a plunger disposed within the throughbore, the plunger comprising a biasing profile;

a locking head coupled to a distal end of the locking arm, the locking head comprising a recess to at least partially receive the distal end of the locking arm; and a load pin that couples the locking head to the distal end of the locking arm and is configured to resist separation of the locking head and the locking arm when in a securing position;

wherein axial translation of the plunger causes the biasing profile to engage the load pin and cause the load pin to transition to a breakaway position;

wherein the load pin comprises a section having an increased shear strength and a section having a reduced shear strength.

2. The rotating locking device of claim 1 wherein the section of the load pin having an increased shear strength is aligned with an interface between the locking head and the locking arm when the load pin is in the securing position.

3. The rotating locking device of claim 1 wherein the section of the load pin having a reduced shear strength is aligned with an interface between the locking head and the locking arm when the load pin is in the breakaway position.

4. The rotating locking device of claim 1 wherein the section of the load pin having a reduced shear strength comprises a section of reduced radial thickness.

5. The rotating locking device of claim 1 wherein a breakaway force applied axially to the locking arm causes the load pin to shear in the breakaway position, which enables the locking head to be decoupled from the locking arm.

6. The rotating locking device of claim 5 wherein the breakaway force is approximately equal to a force required to cause axial translation of the plunger such that the biasing profile engages the load pin and causes the load pin to transition to the breakaway position.

7. The rotating locking device of claim 1, wherein:

the section of the load pin having an increased shear strength is aligned with an interface between the locking head and the locking arm when the load pin is in the securing position; and the section of the load pin having a reduced shear strength is aligned with an interface between the locking head and the locking arm when the load pin is in the breakaway position.

8. A subsea control module, comprising:

one or more electrical or hydraulic connectors to couple to a subsea device to be controlled by the subsea control module;

one or more control submodules configured to operate the electrical or hydraulic connectors;

a rotating locking device configured to couple the subsea control module to the subsea device, the rotating locking device comprising:

a locking arm coupled to a housing and axially rotatable relative to the housing, the locking arm comprising a throughbore and the housing fixed relative to the subsea control module;

a plunger disposed within the throughbore, the plunger comprising a biasing profile;

a locking head coupled to a distal end of the locking arm, the locking head comprising a recess to at least partially receive the distal end of the locking arm; and a load pin that couples the locking head to the distal end of the locking arm and is configured to resist separation of the locking head and the locking arm when in a securing position;

wherein axial translation of the plunger causes the biasing profile to engage the load pin and cause the load pin to transition to a breakaway position; and a lift mandrel coupled to the plunger such that movement of the lift mandrel induces an axial translation of the plunger.

9. The subsea control module of claim 8 wherein the load pin comprises a section having an increased shear strength and a section having a reduced shear strength.

10. The subsea control module of claim 9 wherein the section of the load pin having an increased shear strength is aligned with an interface between the locking head and the locking arm when the load pin is in the securing position.

11. The subsea control module of claim 9 wherein the section of the load pin having a reduced shear strength is aligned with an interface between the locking head and the locking arm when the load pin is in the breakaway position.

12. The subsea control module of claim 8 wherein a breakaway force applied axially to the locking arm causes the load pin to shear in the breakaway position, which enables the locking head to be decoupled from the locking arm.

13. The subsea control module of claim 12 wherein the breakaway force is approximately equal to a force required to cause axial translation of the plunger such that the biasing profile engages the load pin and causes the load pin to transition to the breakaway position.

14. The subsea control module of claim 8 wherein the locking head is configured to engage a corresponding locking profile of the subsea device and wherein the locking head is movable from an unlocked position to a locked position to lock the subsea control module to the subsea device after the locking head engages the locking profile.

15. The subsea control module of claim 9, wherein:

the section of the load pin having an increased shear strength is aligned with an interface between the locking head and the locking arm when the load pin is in the securing position; and the section of the load pin having reduced shear strength is aligned with an interface between the locking head and the locking arm when the load pin is in the breakaway position.

16. A method of unlocking a subsea control module from a subsea device, comprising:

inducing axial translation of a plunger disposed within a throughbore of a locking arm coupled to a locking head, the locking head being in a locked position to couple the subsea control module to the subsea device;

as a result of inducing axial translation of the plunger, engaging, by a biasing profile of the plunger, a load pin that couples the locking head to the locking arm, forcing the load pin to transition to a breakaway position; and applying a breakaway force to the locking arm causing the locking arm to decouple from the locking head.

17. The method of claim 16 further comprising retrieving the subsea control module after the locking arm is decoupled from the locking head.

18. The method of claim 16 wherein causing the load pin to transition to the breakaway position aligns a section of the load pin having a reduced shear strength with an interface between the locking head and the locking arm.

19. The method of claim 16, further comprising:

coupling the locking head to a distal end of the locking arm; and receiving a distal end of the locking arm in a recess of the locking head.

* * * * *